US007165379B1

(12) United States Patent
Lai

(10) Patent No.: US 7,165,379 B1
(45) Date of Patent: Jan. 23, 2007

(54) FORWARD-REVERSE TENSION MECHANISM FOR PACKING MACHINE

(76) Inventor: Tony Lai, No. 56, Industrial 35 Road, Taichung City (TW)

( * ) Notice: Subject to any disclaimer, the term of this patent is extended or adjusted under 35 U.S.C. 154(b) by 0 days.

(21) Appl. No.: 11/187,962

(22) Filed: Jul. 25, 2005

(51) Int. Cl.
*B65B 13/04* (2006.01)

(52) U.S. Cl. ..... 53/589; 53/582; 100/26; 100/29; 100/32

(58) Field of Classification Search ..... 53/389.1, 53/389.4, 399, 589; 100/25, 26, 29, 32
See application file for complete search history.

(56) References Cited

U.S. PATENT DOCUMENTS 4,885,901 A * 12/1989 Sakaki et al. ..... 53/589
5,083,412 A * 1/1992 Sakaki et al. ..... 53/399
5,379,576 A * 1/1995 Koyama ..... 53/589
5,651,306 A * 7/1997 Hoshino ..... 100/26
6,038,967 A * 3/2000 Chak et al. ..... 100/2
6,655,117 B1 * 12/2003 Hoshino ..... 53/589
6,786,027 B1 * 9/2004 Oda et al. ..... 53/589

* cited by examiner

*Primary Examiner*—Louis K. Huynh
*Assistant Examiner*—Thanh Truong

(57) ABSTRACT

A band packing machine includes a body, a transmission unit, a forward-reverse unit and a tension unit. The transmission unit has a rotatable forward-reverse tension cam and a tension cam. The forward-reverse unit includes a forward-reverse motor, a forward-reverse active wheel and a forward-reverse link unit to which a forward-reverse passive wheel is connected. The tension link unit is connected to the tension passive wheel. By controlling the tension cam, the tension passive wheel and the tension active wheel clamp or loosen the bands. The tension unit and the forward-reverse unit are activated by the link units which are activated by cams so that the response time is short. The packing machine is compact and occupies less space in horizontal direction.

9 Claims, 11 Drawing Sheets

FORWARD-REVERSE TENSION MECHANISM FOR PACKING MACHINE

FIELD OF THE INVENTION

The present invention relates to an automatic or semi-automatic packing machine, and more particularly to a forward-reverse tension mechanism which shortens the response time of the band and the horizontal space of the machine is be reduced.

BACKGROUND OF THE INVENTION

A conventional tension mechanism for a packing machine generally includes a tension bar which is rotated with a transmission cam, a passive link, a spring, a pivot link, a clamping member, a driving member driven by a motor, a driving motor which is controlled by a controller and can be operated in forward and backward directions, an activation member on the transmission shaft for activating the controller, and a relay connected to the driving motor. When the driving motor is activated, the driving member drives the passive link to move a distance so as to push a clamping member to clamp the band which is packing an object and the tension bar is rotated so that the controller is activated by the activation member. The relay delays the activation of the driving motor so as to control the tension of the band.

However, in order to provide sufficient space for the rotation of the tension bar, the horizontal space of the machine has to be large enough and this limitation requires more space of the work site. When the guide mechanism pulls the band to pack the objects, the transmission shaft is rotated to control the critic position of the link of the tension bar relative to the transmission cam, a first controller sends a signal to the relay to activate the driving motor after a pre-determined delayed period to drive the driving member to rotate the link of the tension bar, so that the clamping member clamps the band. The sequence of the actions of the above mentioned parts and the time required to allow the tension bar to rotate results a long operation period which is needed to be shortened for efficient purposes. The teeth of the clamping member might damage the bands if they are too sharp, and cannot clamp the bands in position if the teeth are dull. The clamping member is pivotably connected to an end of the tension bar and the band is clamped between the clamping member and the inside of a chamber. The precision of the installation of the clamping member in horizontal direction and the surface of the chamber are required to be highly machined, or the bands cannot be pressed as desired. This required high-cost machining processes to manufacture the related parts.

The present invention intends to provide a forward-reverse tension mechanism which includes less number of parts, occupies less space and shortens the response time.

SUMMARY OF THE INVENTION

The present invention relates to a band packing machine that comprises a body, a transmission unit, a forward-reverse unit, a tension unit, the transmission unit having a main shaft which is connected to a forward-reverse tension cam of the forward-reverse unit and a tension cam of the tension unit. The protrusions on the forward-reverse tension cam and the tension cam are alternatively arranged with each other. The forward-reverse unit includes a forward-reverse motor, a forward-reverse active wheel, a forward-reverse passive wheel and a forward-reverse link unit. The forward-reverse link unit includes a forward-reverse level link, a forward-reverse tension bar and a forward-reverse passive bar. The forward-reverse motor drives the forward-reverse active wheel.

The forward-reverse level link has an end thereof pivotably connected to the body and the other end of the forward-reverse level link is in contact with the forward-reverse cam. An end of the forward-reverse tension bar is located above the forward-reverse level link and a forward-reverse spring is connected between the forward-reverse tension bar and the forward-reverse level link. The other end of the forward-reverse tension bar is pivotally connected to an end of the forward-reverse passive bar. The other end of the forward-reverse passive bar is rotatably connected to a wall of the body. The passive bar is rotatably connected to the forward-reverse passive wheel so as to maintain the forward-reverse passive wheel to be adjacent to the forward-reverse active wheel to clamp bands.

The tension unit includes a tension motor, a tension active wheel, a tension passive wheel and a tension link unit. The tension link unit includes a tension level link, a tension bar and a tension passive bar.

The tension motor drives the tension active wheel, two respective ends of the tension active wheel and the tension passive wheel are matched by teeth. The bands pass through two respective the other ends of the tension active wheel and the tension passive wheel. The tension level link has an end rotatably connected to the body and an end of the tension level link is in contact with the tension cam. The other end of the tension level link is located corresponding to an end of the tension bar. A tension spring is connected between the tension bar and the tension level link. The other end of the tension bar is pivotably connected to an end of the tension passive bar. The other end of the tension passive bar is rotatably connected to the body. The tension passive wheel is rotatably connected to the tension passive bar so as to maintain the tension passive wheel to be adjacent to the tension active wheel. A tension spring is connected between the forward-reverse level link and the tension level link.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
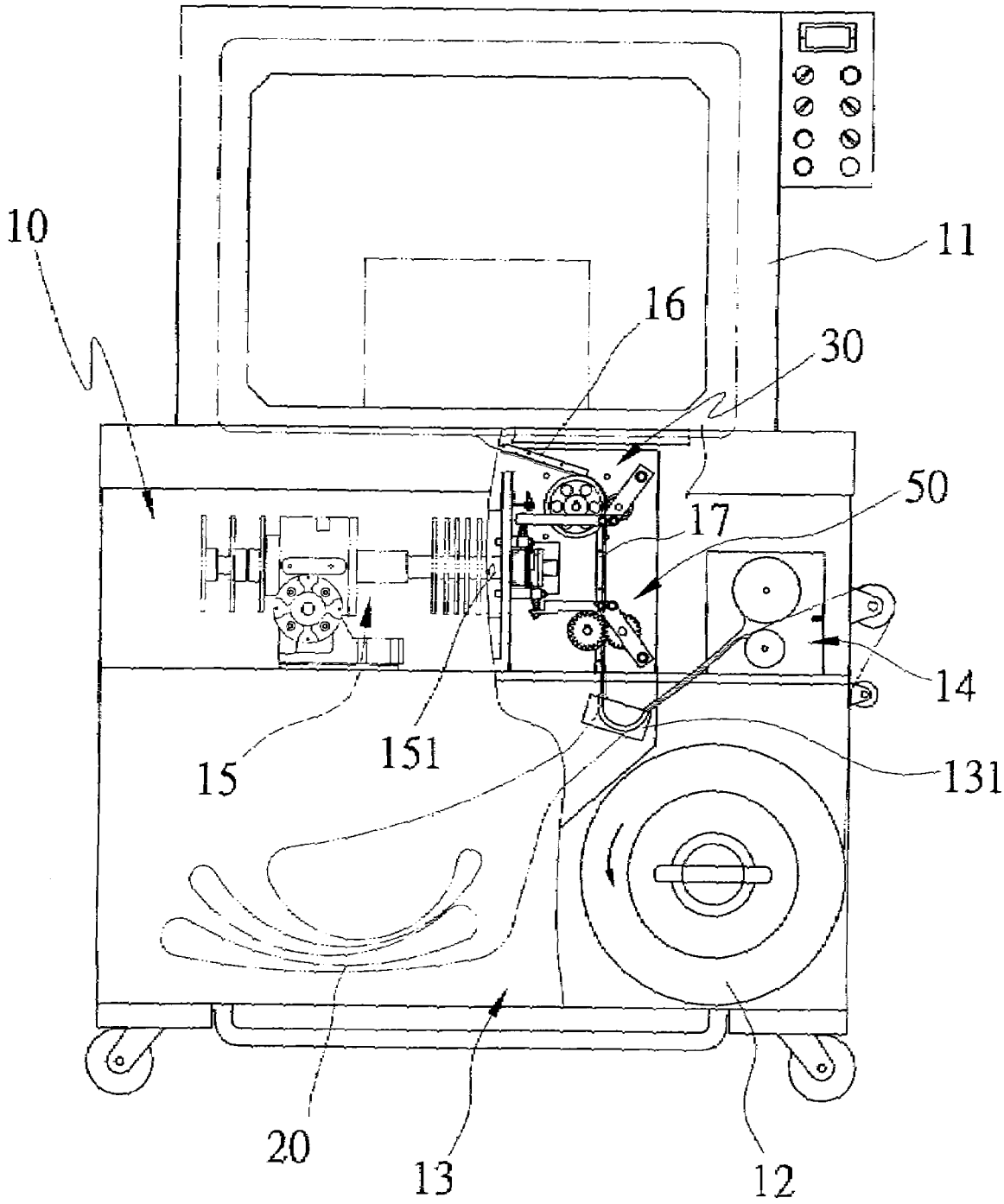
FIG. 1 is a front view of the packing machine of the present invention.

Referring to FIG. 1, the band packing machine of the present invention comprises a body 10 with a guide arch 11 on a top of the body 10 and a transmission unit 15, a forward-reverse unit 30, a tension unit 50, a guide wheel unit 14, a band reel mechanism 12, and a pool box 13. The band 20 is fed forward from the band reel mechanism 12 and enters the pool box 13 via the guide wheel unit 14. A regulation member 131 of the pool box 13 sends the leading end of the band 20 into the tension unit 50 and the forward-reverse unit 30. The band 20 is ready to enter the packing position and the guide arch 11. The forward-reverse unit 30 and the tension unit 50 include an active wheel and a passive wheel, the active wheels and the passive wheels are controlled by link units and cooperated with springs to clamp or loosen the band 20. The forward-reverse unit 30 and the tension unit 50 are activated by cams of transmission unit 15 so that the clamping action can be quick and the space required is reduced.

Figure 2:
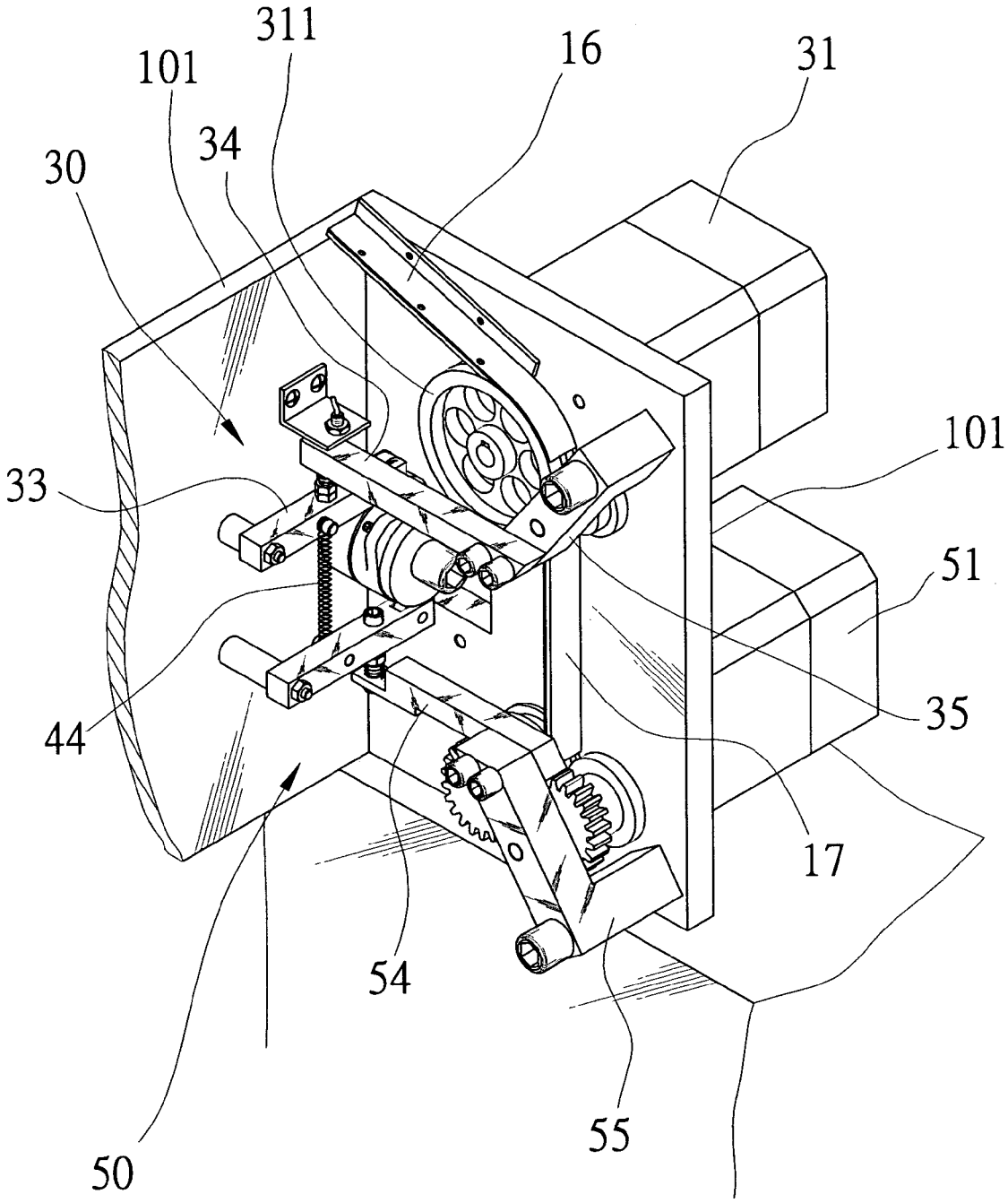
FIG. 2 is a perspective view of the tension unit of the present invention.
Figure 3:
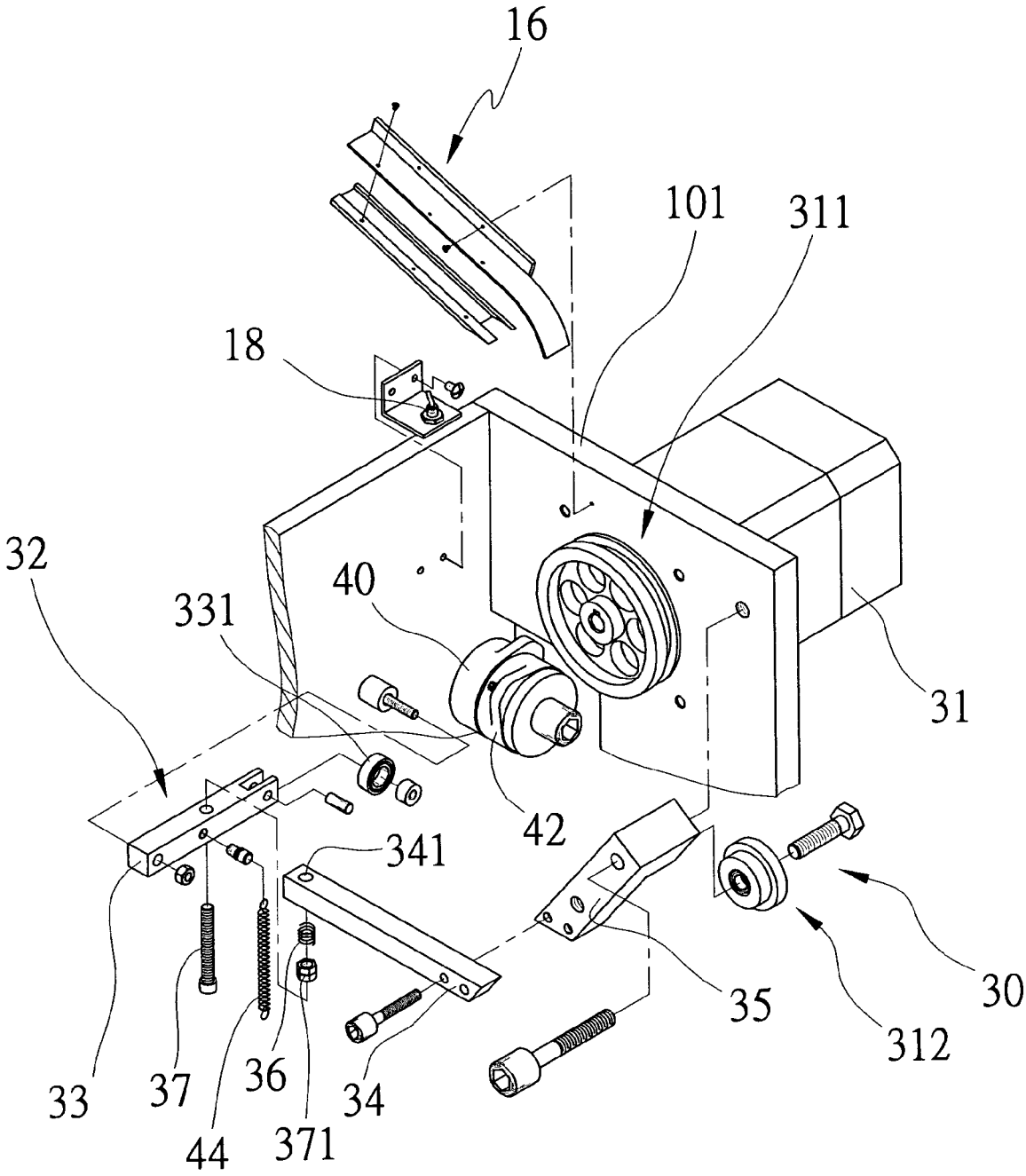
FIG. 3 is an exploded view to show the forward-reverse unit of the present invention.

As shown in FIGS. 1 to 3, the body 10 includes an L-shaped wall 101 where the forward-reverse unit 30 and the tension unit 50 are connected. The forward-reverse unit 30 is located above the tension unit 50. The transmission unit 15 has a main shaft 151 which is located to the other side of the wall 101. An upper band rail 16 is connected to the body 10 and located at a top end of the forward-reverse unit 30 and a middle rail 17 is located between the forward-reverse unit 30 and the tension unit 50. Each of the upper and middle rails 16, 17 is composed of two plates between which the band 20 passes.

The transmission unit 15 is connected to a forward-reverse tension cam 40 of the forward-reverse unit 30 and a tension cam 42 of the tension unit 50. The protrusions on the forward-reverse tension cam 40 and the tension cam 42 are alternatively arranged with each other.

Figure 5:
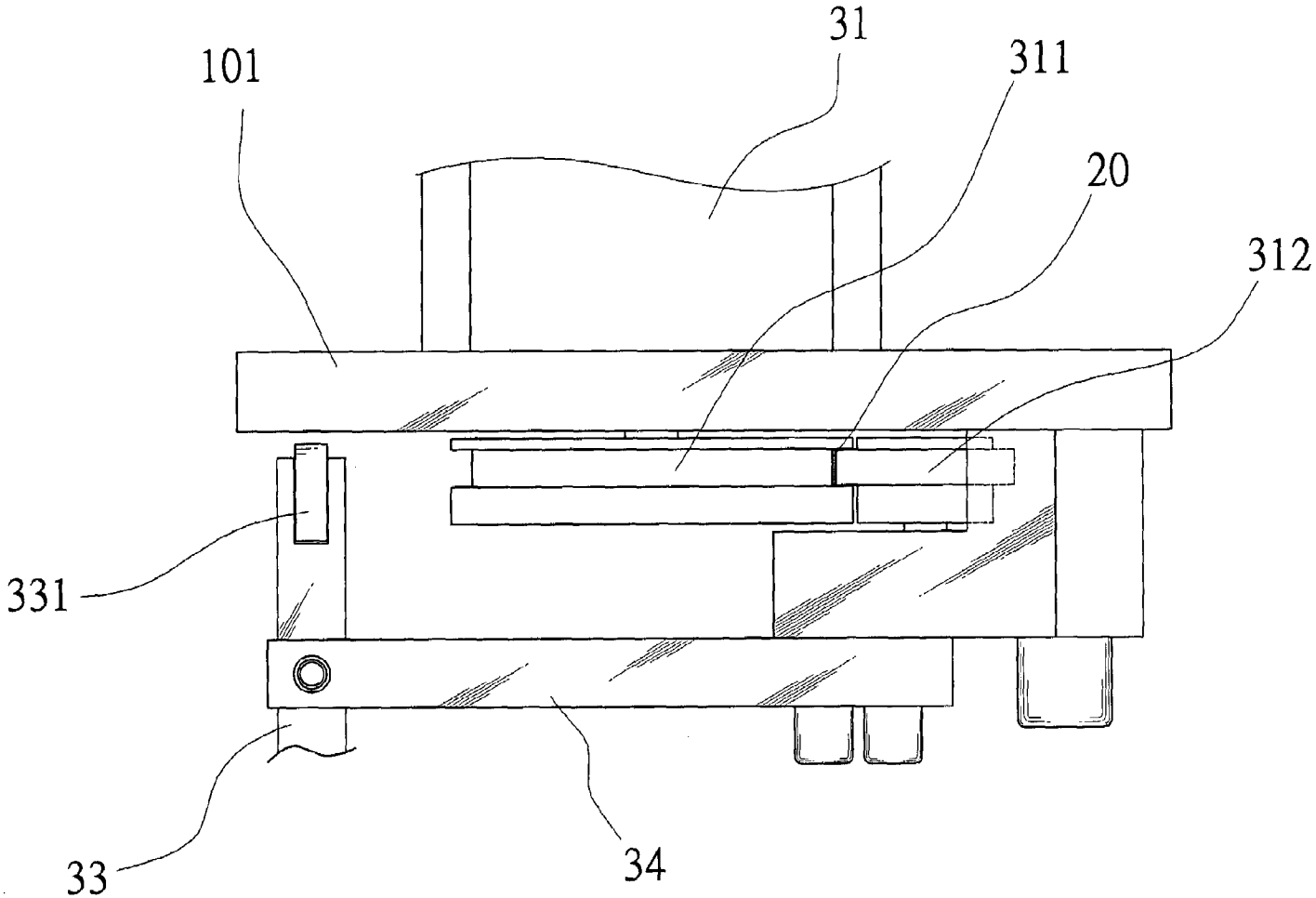
FIG. 5 is a top plan view to show that the band is clamped by the forward-reverse unit.

The forward-reverse unit 30 includes a forward-reverse motor 31, a forward-reverse active wheel 311, a forward-reverse passive wheel 312 and a forward-reverse link unit 32. The forward-reverse link unit 32 includes a forward-reverse level link 33, a forward-reverse tension bar 34 and an L-shaped forward-reverse passive bar 35. The forward-reverse motor 31 is connected to the wall 101 and drives the forward-reverse active wheel 311 to rotate. The forward-reverse passive wheel 312 is located adjacent to the forward-reverse active wheel 311 so that the band 20 is clamped between the forward-reverse passive wheel 312 and the forward-reverse active wheel 311 as shown in FIG. 5. Besides, the forward-reverse level link 33 has an end thereof pivotably connected to the wall 101 of the body 10 and the other end of the forward-reverse level link 33 is connected to a forward-reverse rotary member 331 which is a bearing in this embodiment. The rotary member 331 is in contact with the forward-reverse cam 40. An end of the forward-reverse tension bar 34 located above the middle portion of the forward-reverse level link 33 and a forward-reverse spring 36 is connected between the forward-reverse tension bar 34 and the forward-reverse level link 33. A bolt 37 extends through the forward-reverse level link 33 to which two nuts 371 are connected, the forward-reverse spring 36 and a hole 341 in the forward-reverse tension bar 34 so that the forward-reverse tension bar 34 is biased by the forward-reverse spring 36. The other end of the forward-reverse tension bar 34 is pivotally connected to an end of the forward-reverse passive bar 35. The other end of the forward-reverse passive bar 35 is rotatably connected to a wall 101 of the body 10. The middle portion of the passive bar 35 is rotatably connected to the forward-reverse passive wheel 312 so as to maintain the forward-reverse passive wheel 32 to be adjacent to the forward-reverse active wheel 311 to clamp bands 20. In normal condition, the forward-reverse active wheel 311 and the forward-reverse passive wheel 312 clamps the band 20.

Figure 4:
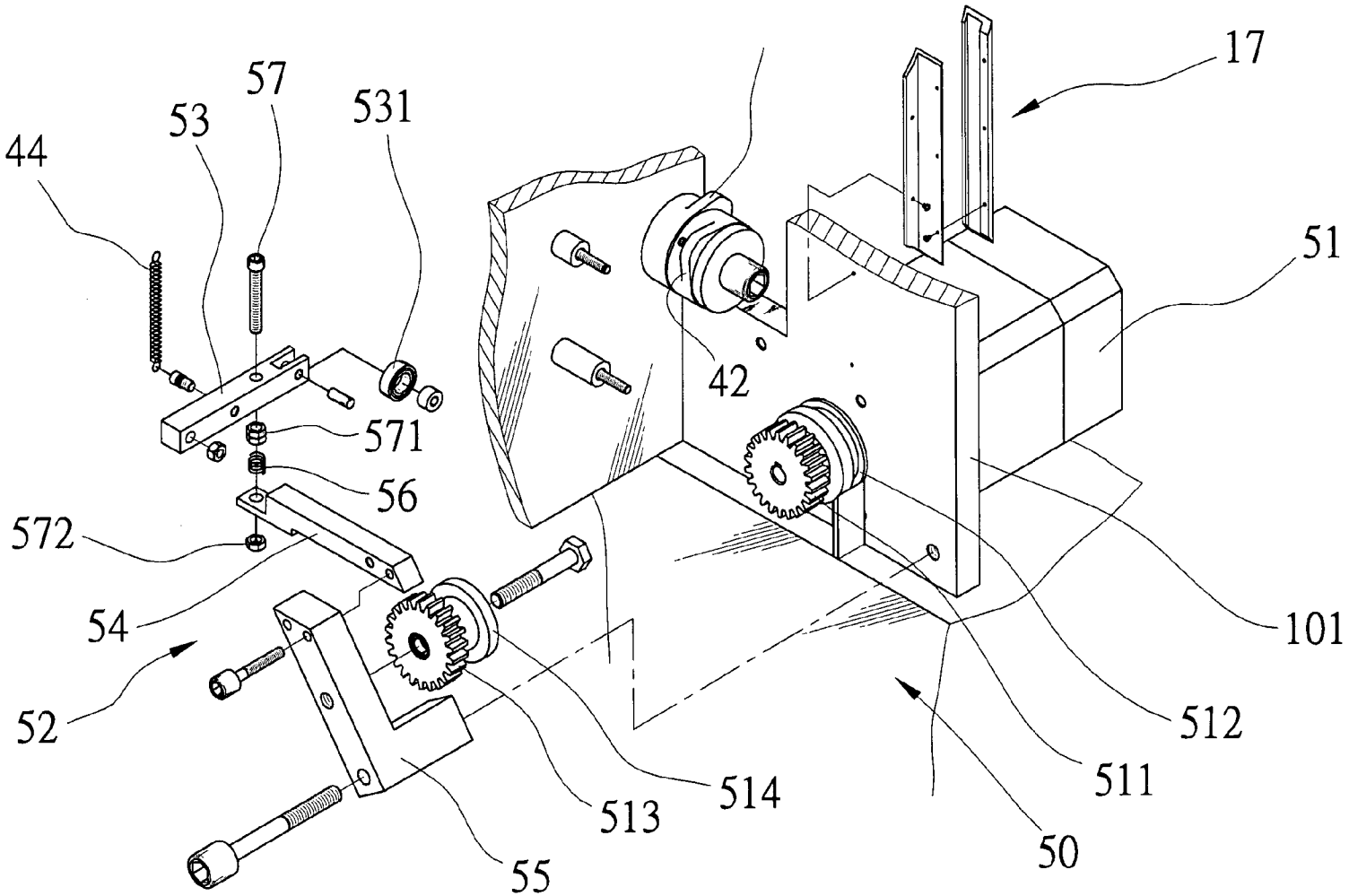
FIG. 4 is an exploded view to show the tension unit of the present invention.

As shown in FIGS. 1, 2 and 4, the tension unit 50 includes a tension motor 51, a tension active wheel 511, a tension passive wheel 513 and a tension link unit 52. The forward-reverse link unit 32 includes a tension level link 53, a tension bar 54 and an L-shaped tension passive bar 55.

Figure 6:
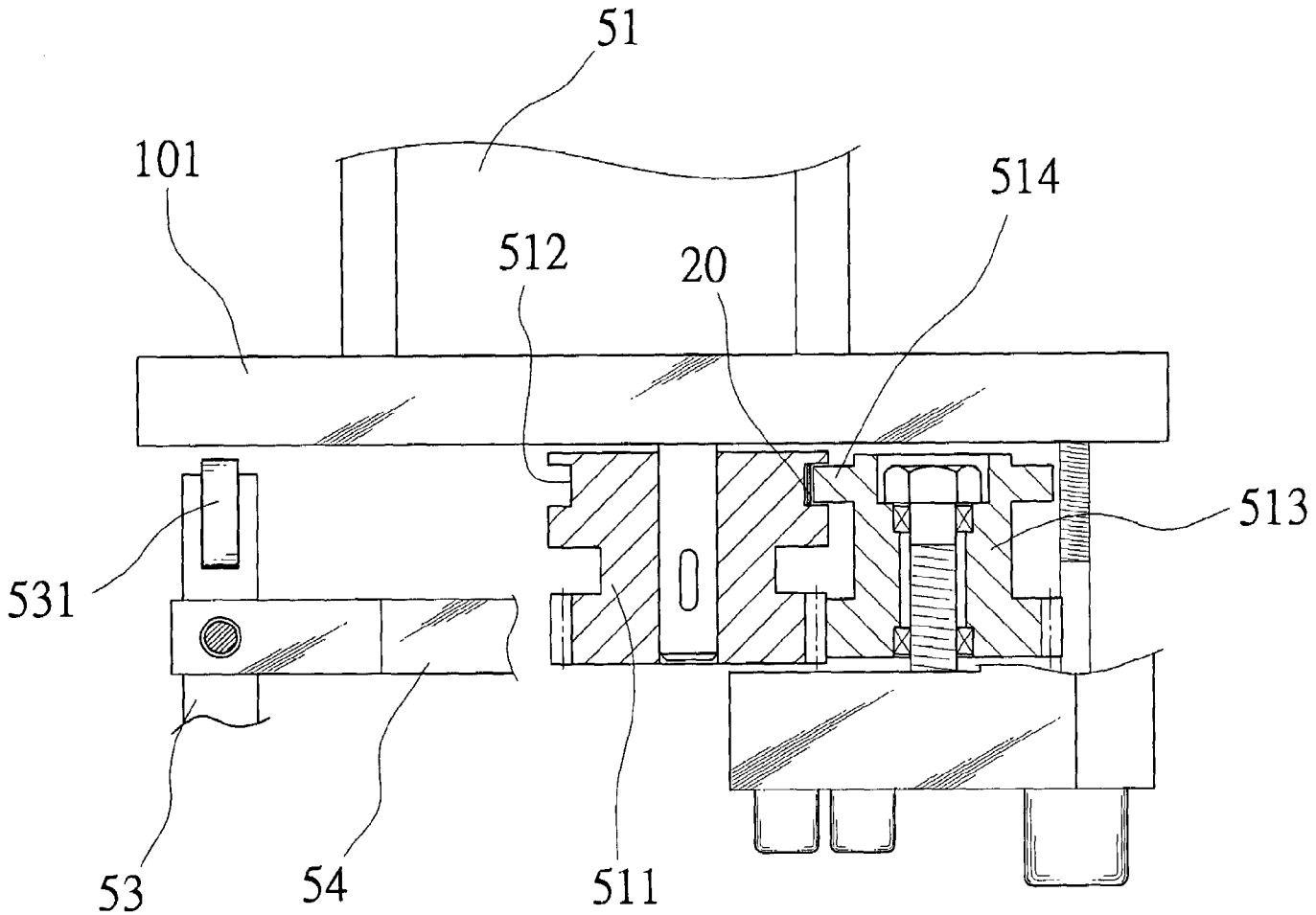
FIG. 6 is a top plan view to show that the band is clamped by the tension unit.
Figure 7:
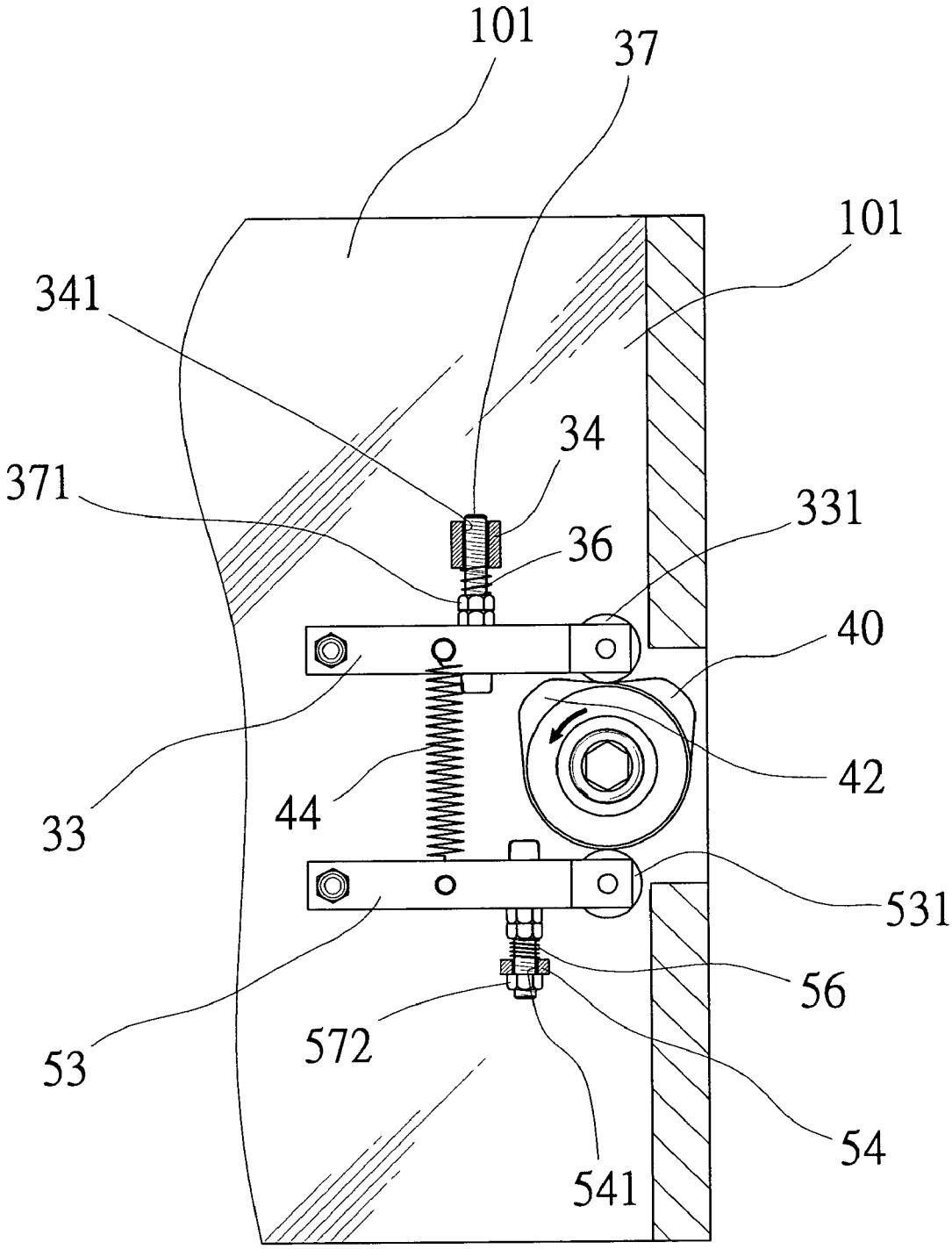
FIG. 7 shows the tension level link, the forward-reverse level link and the cam.

The main shaft 151 of the transmission unit 15 is fixed on the wall 101 and drives the tension active wheel 511. The tension passive wheel 513 is located on a side of the tension active wheel 511 so that the band 20 can be clamped therebetween. As shown in FIG. 6, two respective ends of the tension active wheel 511 and the tension passive wheel 513 are matched by teeth. The bands 20 passing through two respective the other ends of the tension active wheel 511 and the tension passive wheel 513. The tension active wheel 511 has an active groove 512 and the tension passive wheel 513 has a disk 514 which is engaged with the active groove 512 such that the bands 20 is clamped between the disk 514 and an inside of the active groove 512.

The tension level link 53 has an end rotatably connected to the wall 101 of the body 10 and an end of the tension level link 53 is connected with a tension rotary member 531 which is a bearing in this embodiment, and the tension rotary member 531 is in contact with the tension cam 42. By this arrangement, the tension level link protrudes from the forward-reverse level link. The other end of the tension level link 53 is located corresponding to an end of the tension bar 54. A tension spring 56 is connected between the tension bar 54 and the tension level link 53. A bolt 57 extends through the tension level link 53 to which two nuts 571 are connected, the tension spring 56 and a through hole 541 in the tension bar 54 so that the tension bar 54 is biased by the tension spring 56. The bolt 57 that extends through the tension bar 54 is connected to a bottom nut 572 which is used to press the tension bar 54. The other end of the tension bar 54 pivotably connected to an end of the tension passive bar 55. The other end of the tension passive bar 55 is rotatably connected to the wall 101 of the body 10. The tension passive wheel 513 is rotatably connected to the tension passive bar 55 so as to maintain the tension passive wheel 513 to be adjacent to the tension active wheel 511. When the band 20 is not clamped securely, there is a gap between the tension passive wheel 513 and the tension active wheel 511 so that the band 20 is moved freely.

As shown in FIGS. 2 and 3, a limit switch 18 is connected to he wall 101 of the body 10 and located above the tension bar 34 and close to the forward-reverse spring 36. A tension spring 44 is connected between the forward-reverse level link 33 and the tension level link 53.

Figure 8:
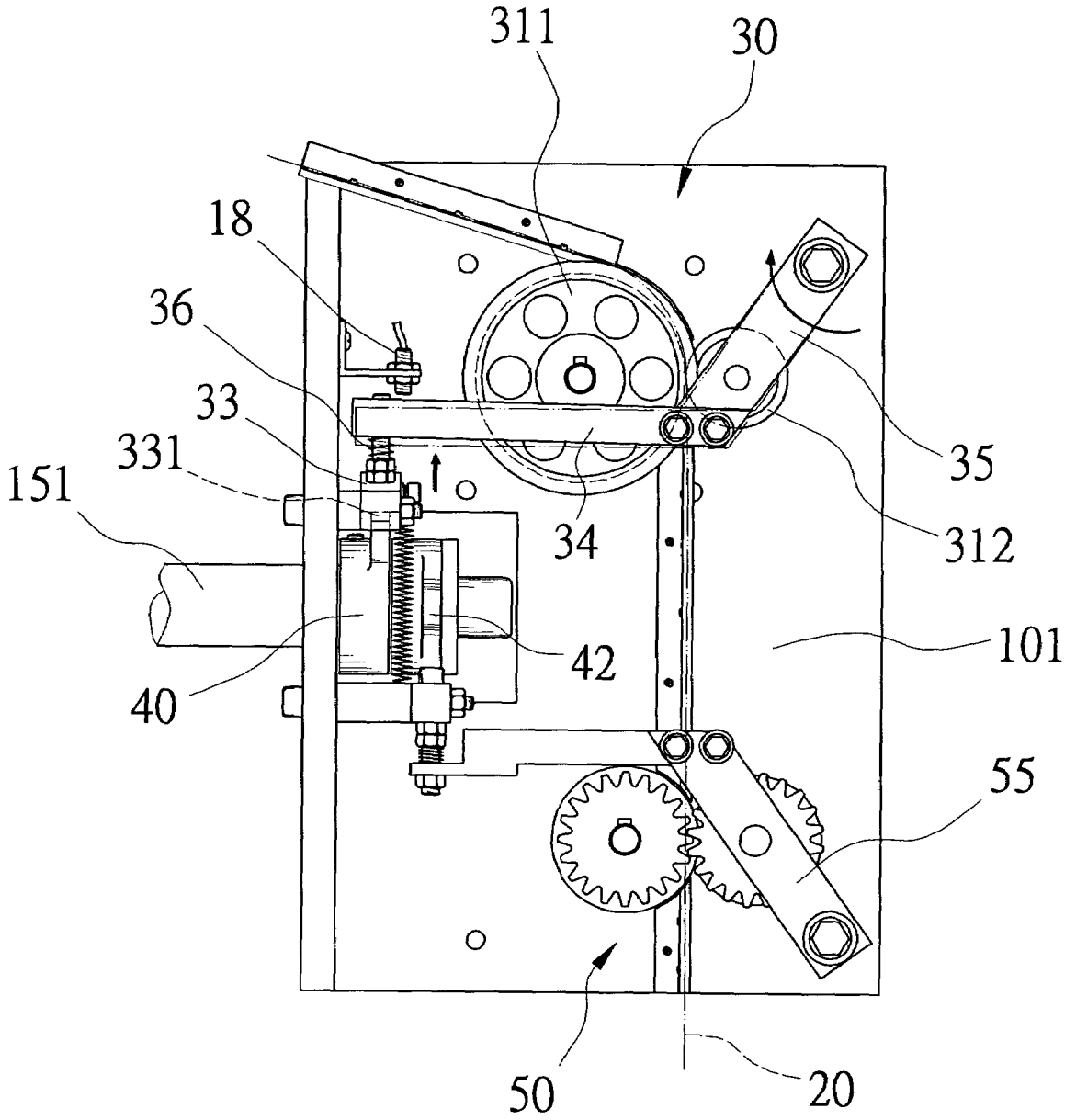
FIG. 8 shows that the band is moved in reverse.

As shown in FIGS. 1 and 2, when the band 20 is fed by the guide wheel unit 14, the pool box 13 and enters the forward-reverse unit 30, the forward-reverse motor 31 rotates in reverse direction at high speed to feed the band 20 and sends the band 20 to a pre-set point in the guide arch 14, The limit switch 18 detects the band 20 is in the desired position as shown in dotted lines in FIG. 8.

Figure 9:
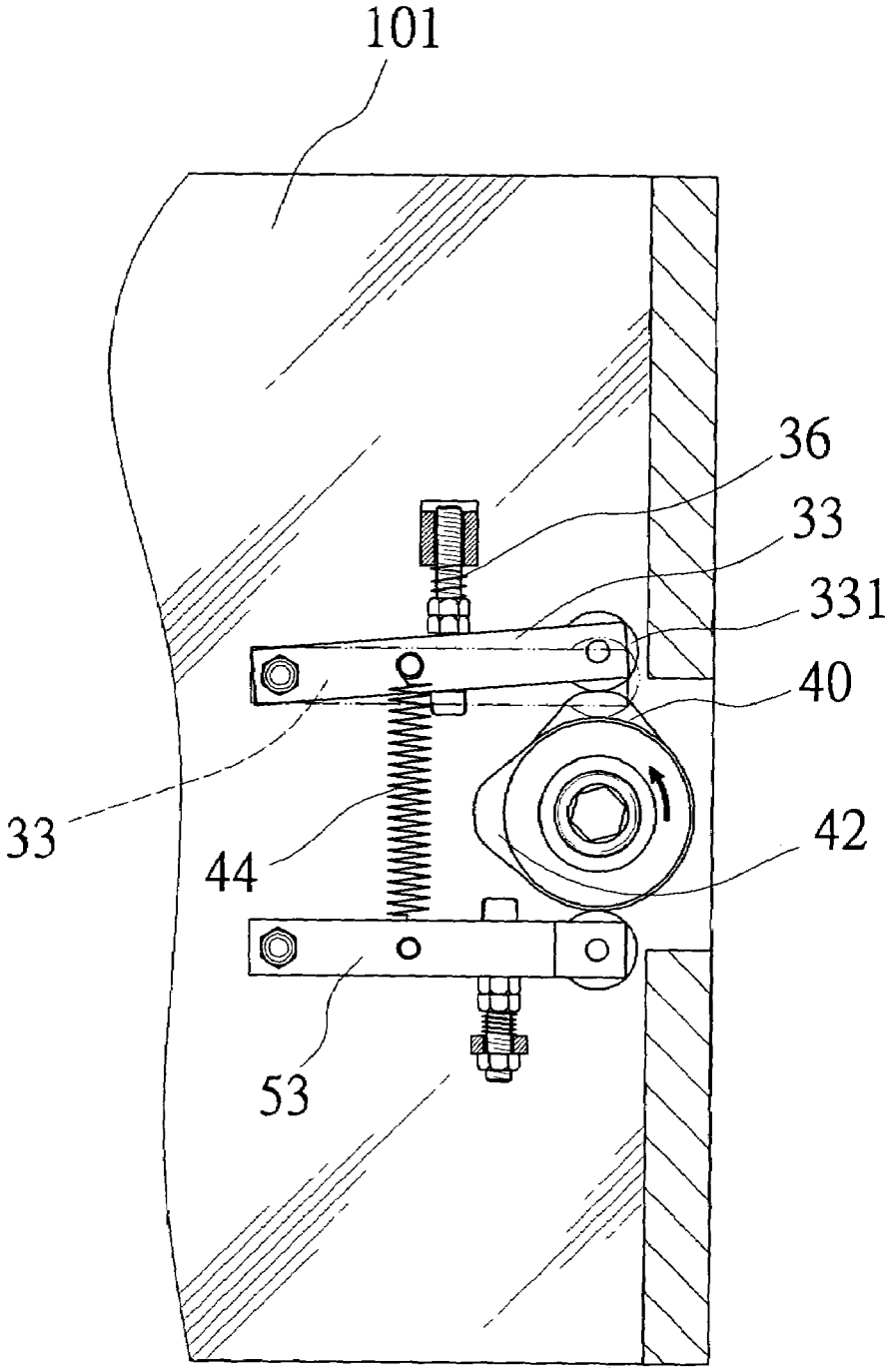
FIG. 9 shows that the status of the cam when the band is moved in reverse.

When packing items, the main shaft 151 is rotated counter clockwise and the forward-reverse cam 40 is co-rotated with the main shaft 151 till a pre-set stop position. As shown in FIGS. 2, 8 and 9, the forward-reverse cam 40 lifts the rotary member 331 of the forward-reverse level link 33, and the forward-reverse bar 34 is raised as shown in solid lines in FIG. 8. The limit switch 18 then detects and sends a signal to a sensor to count time for retrieving the band 20. The other end of the forward-reverse bar 34 moves upward so that the forward-reverse bar 34 is pivoted about the point on the wall 101 to drive the forward-reverse passive wheel 312 toward the forward-reverse active wheel 311 to clamp the band 20. The forward-reverse motor 31 rotates clockwise to retrieve the band 20. The time for retrieving the band can be set by programmable controllers.

Figure 10:
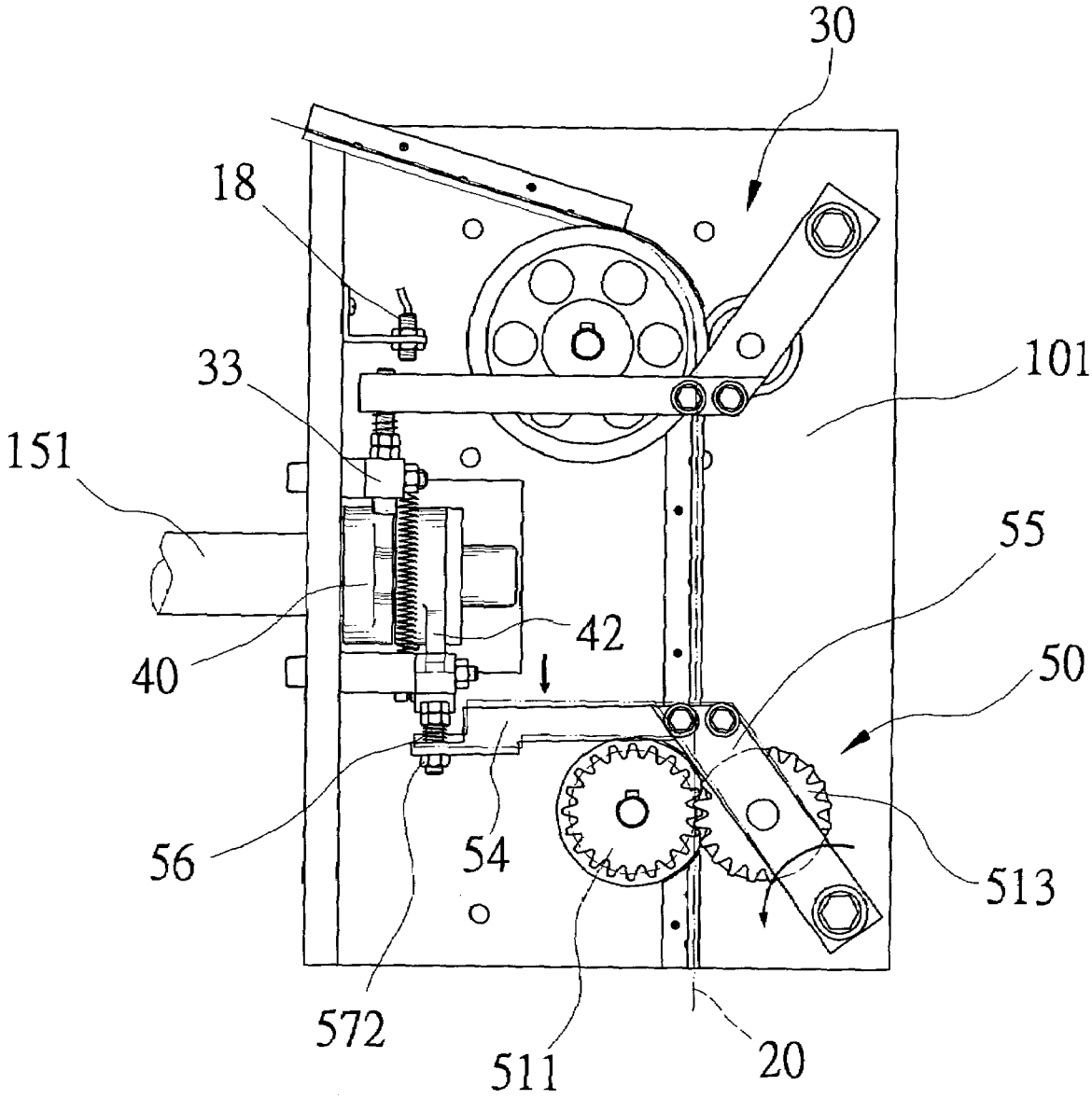
FIG. 10 shows that the band is in tension status.
Figure 11:
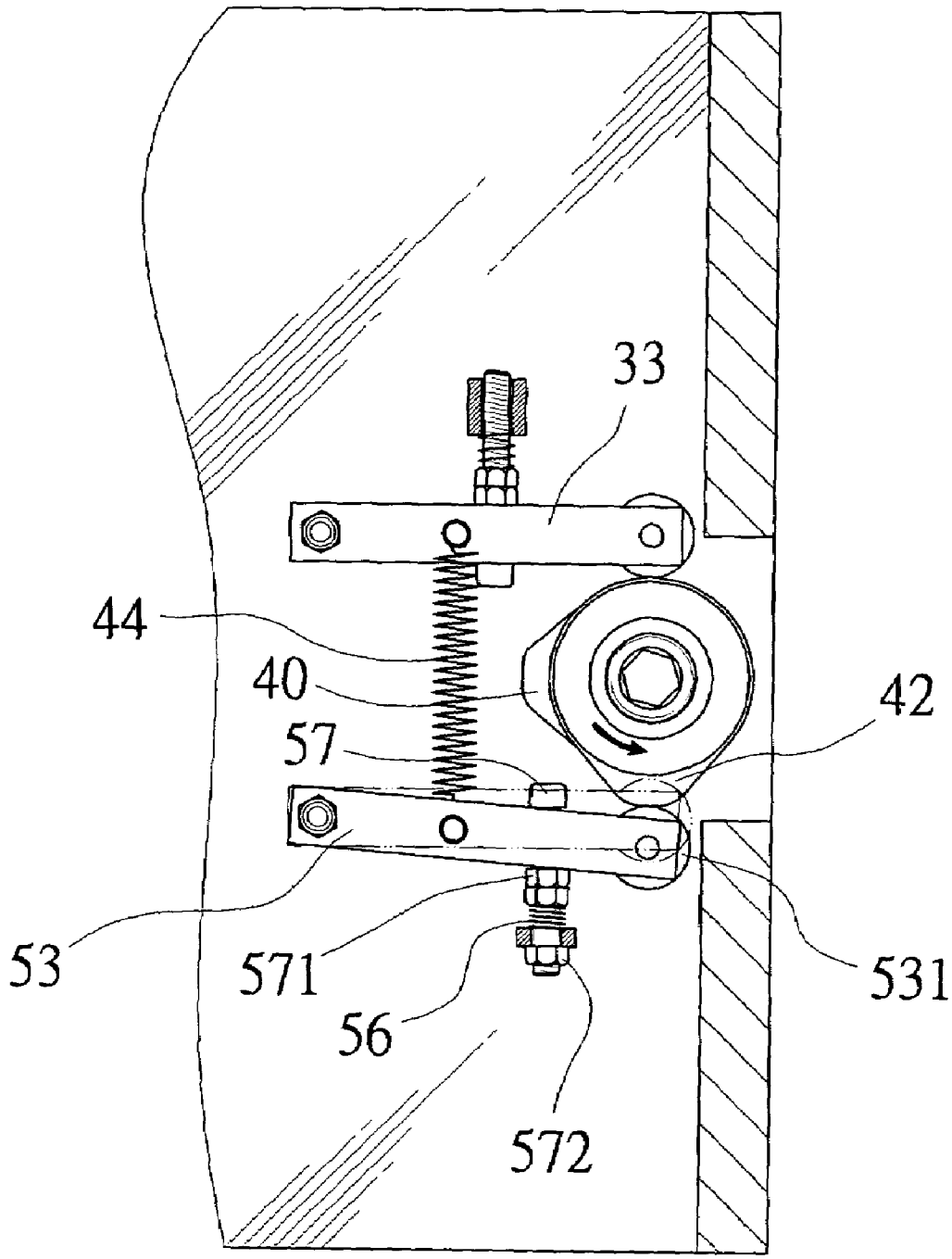
FIG. 11 shows that the status of the cam when the band is in tension status.

After the counting for retrieving the band 20, the main shaft 151 keeps on rotating for about 0.08 seconds, as shown in FIGS. 10 and 11, the forward-reverse cam 40 removes from the forward-reverse level link 33 and returns to its original position by the tension spring 44 till the operation of main shaft 151 is to let the tension cam 42 be activated to push the tension rotary member 531 downward. The other end of the tension passive bar 55 moves upward and rotates in reverse about the point on the wall 101. This results the tension active wheel 511 and the tension passive wheel 513 move toward each other and the teeth are matched firmly, and the active groove 512 and the disk 514 clamps the band 20. The tension motor 51 rotates clockwise to pull the band 20 and time starts to count. The main shaft 151 keeps on rotating till the tension rotary member 531 touches the lowest point of the tension cam 42. The band 20 is to be loosened and the machine starts to proceed fusion and cutting processes to the band 20. The main shaft 151 keeps on rotating and the tension unit 50 is disengaged from the tension cam 42 and force of the tension spring 44 returns the parts back to their original positions. The forward-reverse motor 31 is activated to send the band 20 into the pool box 13 to be ready for the next packing operation.

The tension spring 56 and the forward-reverse spring 36 are adjusted by moving he nuts 371, 571 along the bolts 37, 57 to control the tension bar 54 and the forward-reverse tension bar 34 so as to adjust the clamping force to the band 20 from the tension passive wheel 513, the forward-reverse passive wheel 312.

While we have shown and described the embodiment in accordance with the present invention, it should be clear to those skilled in the art that further embodiments may be made without departing from the scope of the present invention.

What is claimed is:

1. A band packing machine comprising:

a body, a transmission unit, a forward-reverse unit, a tension unit, the transmission unit having a main shaft which is connected to a forward-reverse tension cam of the forward-reverse unit and a tension cam of the tension unit, protrusions on the forward-reverse tension cam and the tension cam being alternatively arranged with each other;

the forward-reverse unit including a forward-reverse motor, a forward-reverse active wheel, a forward-reverse passive wheel and a forward-reverse link unit, the forward-reverse link unit including a forward-reverse level link, a forward-reverse tension bar and a forward-reverse passive bar, the forward-reverse motor driving the forward-reverse active wheel, the forward-reverse level link having an end thereof pivotably connected to the body and the other end of the forward-reverse level link being in contact with the forward-reverse cam, an end of the forward-reverse tension bar located above the forward-reverse level link and a forward-reverse spring connected between the forward-reverse tension bar and the forward-reverse level link, the other end of the forward-reverse tension bar pivotally connected to an end of the forward-reverse passive bar, the other end of the forward-reverse passive bar being rotatably connected to a wall of the body, the passive bar being rotatably connected to the forward-reverse passive wheel so as to maintain the forward-reverse passive wheel to be adjacent to the forward-reverse active wheel to clamp bands;

the tension unit including a tension motor, a tension active wheel, a tension passive wheel and a tension link unit, the forward-reverse link unit including a tension level link, a tension bar and a tension passive bar;

the tension motor driving the tension active wheel, two respective ends of the tension active wheel and the tension passive wheel being matched by teeth, the bands passing through two respective the other ends of the tension active wheel and the tension passive wheel, and the tension level link having an end rotatably connected to the body and an end of the tension level link being in contact with the tension cam, the other end of the tension level link being located corresponding to an end of the tension bar, a tension spring connected between the tension bar and the tension level link, the other end of the tension bar pivotably connected to an end of the tension passive bar, the other end of the tension passive bar being rotatably connected to the body, the tension passive wheel being rotatably connected to the tension passive bar so as to maintain the tension passive wheel to be adjacent to the tension active wheel, a tension spring connected between the forward-reverse level link and the tension level link.

2. The machine as claimed in claim 1, wherein the main shaft of the transmission unit is located a side of the forward-reverse unit and the tension unit.

3. The machine as claimed in claim 2, wherein an upper band rail is connected to the body and located at a top end of the forward-reverse unit and a middle rail is located between the forward-reverse unit and the tension unit.

4. The machine as claimed in claim 1, the forward-reverse passive bar and the tension passive bar are both L-shaped members.

5. The machine as claimed in claim 1, wherein the forward-reverse level link and the tension level link each have a tension rotary member connected to two respective ends which are located corresponding to the forward-reverse cam an the tension cam.

6. The machine as claimed in claim 1, wherein a bolt extends through the forward-reverse level link to which two nuts are connected, the forward-reverse spring and a hole in the forward-reverse tension bar so that the forward-reverse tension bar is biased by the forward-reverse spring.

7. The machine as claimed in claim 1, wherein the tension active wheel an active groove and the tension passive wheel has a disk which is engaged with the active groove such that the bands is clamped between the disk and an inside of the active groove.

8. The machine as claimed in claim 1, wherein a bolt extends through the tension level link to which two nuts are connected, the tension spring and a through hole in the tension bar so that the tension bar is biased by the tension spring, the bolt that extends through the tension bar is connected to a bottom nut.

9. The machine as claimed in claim 1, wherein a limit switch is connected to the body and located above the tension bar and close to the forward-reverse spring.

* * * * *